US010407805B2

(12) United States Patent
Lim

(10) Patent No.: US 10,407,805 B2
(45) Date of Patent: Sep. 10, 2019

(54) CANDLE TAPE FOR IGNITION AND METHOD OF MANUFACTURING THE SAME

(71) Applicant: HINGE KOREA CO., LTD., Incheon (KR)

(72) Inventor: Byung Taek Lim, Bucheon-si (KR)

(73) Assignee: HINGE KOREA CO., LTD., Incheon (KR)

( * ) Notice: Subject to any disclaimer, the term of this patent is extended or adjusted under 35 U.S.C. 154(b) by 146 days.

(21) Appl. No.: 15/438,229

(22) Filed: Feb. 21, 2017

(65) Prior Publication Data

US 2017/0240831 A1 Aug. 24, 2017

(30) Foreign Application Priority Data

Feb. 22, 2016 (KR) ..... 10-2016-0020419

(51) Int. Cl.

| | |
|---|---|
| ***C10L 11/06*** | (2006.01) |
| ***C10L 11/04*** | (2006.01) |
| ***D03D 15/00*** | (2006.01) |
| ***B05D 1/18*** | (2006.01) |
| ***D03D 1/00*** | (2006.01) |
| ***C06F 5/04*** | (2006.01) |

(52) U.S. Cl.
CPC ..... *D03D 15/00* (2013.01); *C06F 5/04* (2013.01); *D03D 1/00* (2013.01)

(58) Field of Classification Search
CPC combination set(s) only.
See application file for complete search history.

(56) References Cited

U.S. PATENT DOCUMENTS 4,147,518 A * 4/1979 De Hart ..... C10L 11/08 44/519
2014/0154636 A1* 6/2014 Thompson ..... F23D 3/16 431/126

FOREIGN PATENT DOCUMENTS

CN 103314938 A * 9/2013
KR 10-1990-0008014 A 6/1990
KR 10-2011-0122039 A 11/2011
KR 10-1307417 A 9/2013

* cited by examiner

*Primary Examiner* — Ellen M McAvoy
*Assistant Examiner* — Chantel L Graham
(74) *Attorney, Agent, or Firm* — Novick, Kim & Lee, PLLC; Jae Youn Kim

(57) ABSTRACT

Provided is a method of manufacturing a candle tape for ignition. The method includes: weaving a core fiber into a core fabric; cutting the core fabric in a diagonal direction in a unit of a predetermined width; and coating paraffin on a core strip prepared through the cutting.

16 Claims, 4 Drawing Sheets

CANDLE TAPE FOR IGNITION AND METHOD OF MANUFACTURING THE SAME

BACKGROUND OF THE INVENTION

1. Field of the Invention

The present invention relates to a candle tape for ignition and a method of manufacturing the same, and more particularly, to a candle tape for ignition used as an ignition means in various situations, which may be easily cut with a hand by a required length without a separate tool, and which is formed in a roll tape form to be conveniently portable, and a method of manufacturing the same.

2. Description of the Related Art

As well known in the art, when barbecue cooking or various types of meat grilling are performed outdoors, since solid fuel such as firewood or briquettes is usually used, the solid fuel must be stably ignited prior to grilling. Conventionally, there is a method of directly using a portable gas lighter to ignite solid fuel. In this case, a risk of burns may happen because the solid fuel must be held with the lighter turned on for several tens of seconds until the solid fuel is ignited. Specifically, in the case of wind blowing, it took a longer time to ignite the solid fuel, or even the lighter flame was blown out in the wind, so that it may be impossible to ignite the solid fuel.

In consideration of the above-mentioned problems, there is proposed a method using an ignition medium such as a paper or an instant ignition charcoal called 'Bungae-tan'. However, in the case of the paper, the flame does not last for a long time and it is difficult to obtain a paper outdoors suddenly. In the case of the instant ignition charcoal, while the flame is stable and lasts for a long time, the instant ignition charcoal is not only bulky, but also continuously generates harmful substances during burning.

In addition, there are related arts to the present invention as follows.

Related Art 1: Korean Unexamined Patent Publication No. 10-1990-0008104

According to related art 1, there is provided a method of manufacturing an ignition agent which includes: after cutting the rod-shaped material and bonding an ignition agent main body to the cut rod-shaped material, immersing the cut rod-shaped material into a kerosene bath for about 10 minutes such that a kerosene non-infiltration portion remains at a central portion of the ignition material; and after forming a kerosene infiltration portion on the remaining portions, immersing the ignition agent main body into a paraffin wax solution bath for about one minute and drying it, such that a paraffin wax layer is formed on the entire outer periphery surface of the ignition agent main body as a cuticle.

Related Art 2: Korean Unexamined Patent Publication No. 10-2011-0122039

According to related art 2, there is provided a method of manufacturing fuel using nut of palm tree, which include: a first step of pulverizing palm nuts into a powder using a pulverizer; a second step of drying the palm nut powder to have a water content of 5% to 10%; a third step of pelletizing the dried palm nut powder by using a pellet molder; a fourth step of administering alcohol to the molded pellet at the rate of 1% to 10%; a fifth step of forming a (paraffin) coating layer having a thickness of 0.05 mm to 0.2 mm on the surface of the alcohol-administered pellet; and a sixth step of drying the coated pellet.

Related Art 3: Korean Registered Patent No. 10-1307417

According to related art 3, there is provided a method of manufacturing an ignition material, which includes the steps of: dissolving paraffin; adding sawdust or safflower to the melted paraffin; adding charcoal powder to the paraffin and sawdust added material to form an ignition composite material; containing the ignition composite material into a paper container; and naturally drying the ignition composite material contained in the paper container to solidify the ignition composite material.

Meanwhile, as well as the above-described related arts, a candle tape is commercially available. However, this is merely a decorative tape such as a lace for decorating the surface of a candle when the candle is manually produced, and it may be understood that the candle tape has nothing to do with the present invention.

DOCUMENT OF RELATED ART

Patent Document (Patent document 1) Related art 1: Korean Unexamined Patent Publication No. 10-1990-0008104 (Title of the invention: Method of manufacturing ignition agent)

(Patent document 2) Related art 2: Korean Unexamined Patent Publication No. 10-2011-0122039 (Title of the invention: Method of manufacturing fuel using nut of palm tree)

(Patent document 3) Related art 3: Korean Registered Patent No. 10-1307417 (Title of the invention: Method of manufacturing an ignition material)

SUMMARY OF THE INVENTION

To solve the problems described above, an object of the present invention is to provide a candle tape for ignition, which is used as an ignition means in various situations, which may be easily cut with a hand by a required length without a separate tool, and which is formed in a roll tape form to be conveniently portable, and a method of manufacturing the same To achieve the objects described above, according to one aspect of the present invention, there is provided a method of manufacturing a candle tape for ignition, which includes: weaving a core fiber into a core fabric; cutting the core fabric in a diagonal direction in a unit of a predetermined width; and coating paraffin on a core strip prepared through the cutting.

The coating of the paraffin includes immersing the core strip in liquid paraffin contained in a paraffin tank.

According to another aspect of the present invention, there is provided a method of manufacturing a candle tape for ignition, which includes: weaving a core fiber into a core fabric; coating paraffin on the core fabric; and cutting the core fabric, on which the paraffin is coated, in a diagonal direction in a unit of a predetermined width.

The coating of the paraffin includes immersing the core fabric in liquid paraffin contained in a paraffin tank.

The core fabric includes a jute fiber.

The method further includes bonding ends of at least two core strips coated with paraffin to each other through thermal compression in a state that the ends of the at least two core strips overlap each other.

The method further includes shaping the core strip, on which the paraffin is coated, in a roll tape shape.

According to still another aspect of the present invention, there is provided a candle tape for ignition, includes: a core strip having a strip shape of a weave configuration crossing in a diagonal direction; and paraffin coated on the core strip.

The candle tape is shaped in a form of a roll tape.

The core fabric includes a jute fiber.

According to the candle tape for ignition of the present invention, when a solid fuel such as a firewood or a briquette is to be ignited in various indoor and outdoor situations, the candle tape for ignition may be easily cut by hand by a hand without any tools such as a knife or scissors.

In addition, since Because it is eco-friendly material and coarse and tough jute fibers are core material and paraffin is poured, candle tape is easy to ignite. It can maintain flame for a relatively long time without generating harmful substances in the combustion process. It does not turn off easily.

Since the candle tape is molded in a roll tape form, the candle tape may be conveniently to be kept and portable. In addition, since the candle tape is flexible, the candle tape may be used in various manners, for example, the candle tape may be wound around a tree or the candle tape may be crumpled in use.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Hereinafter, a candle tape for ignition and a method of manufacturing the same according to preferable embodiments of the present invention will be described with reference to the accompanying drawings.

Figure 1:
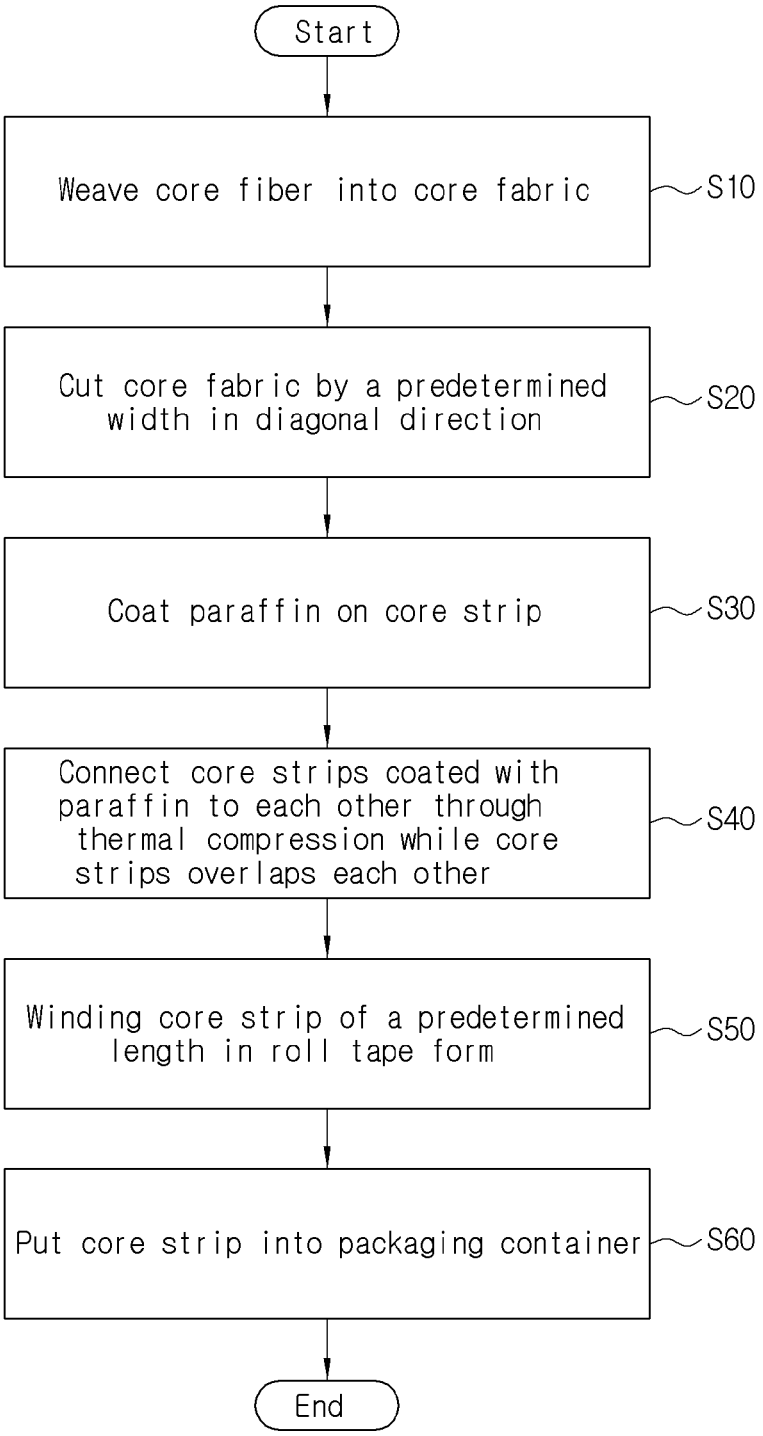
FIG. 1 is a flowchart illustrating a method of manufacturing a candle tape for ignition according to an embodiment of the present invention.
Figure 2:
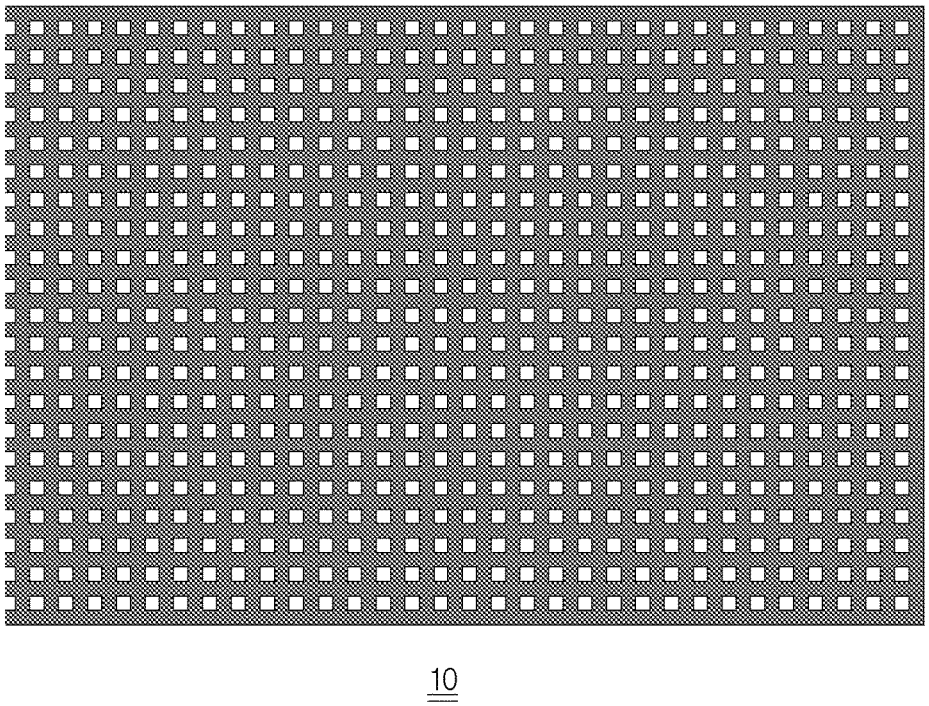
FIG. 2 is a plan view exemplarily showing a core fabric in a method of manufacturing a candle tape for ignition according to an embodiment of the present invention.

FIG. 1 is a flowchart illustrating a method of manufacturing a candle tape for ignition according to an embodiment of the present invention. FIG. 2 is a plan view exemplarily showing a core fabric in a method of manufacturing a candle tape for ignition according to an embodiment of the present invention. As shown in FIGS. 1 and 2, in step S10, a core fiber is woven into a core fabric 10 having a roll shape. As the core fiber, a synthetic fiber and a natural fiber all may be used. However, it is preferable to use, as the core fiber, the natural fiber such as a jute fiber or a pulp fiber because a spark is retained for a relatively long time period without generating harmful substances (toxic gas, etc.) during burning, where the jute or pulp fiber is used to manufacture sturdy bags because the jute and pulp fibers are coarse and sturdy.

Figure 3:
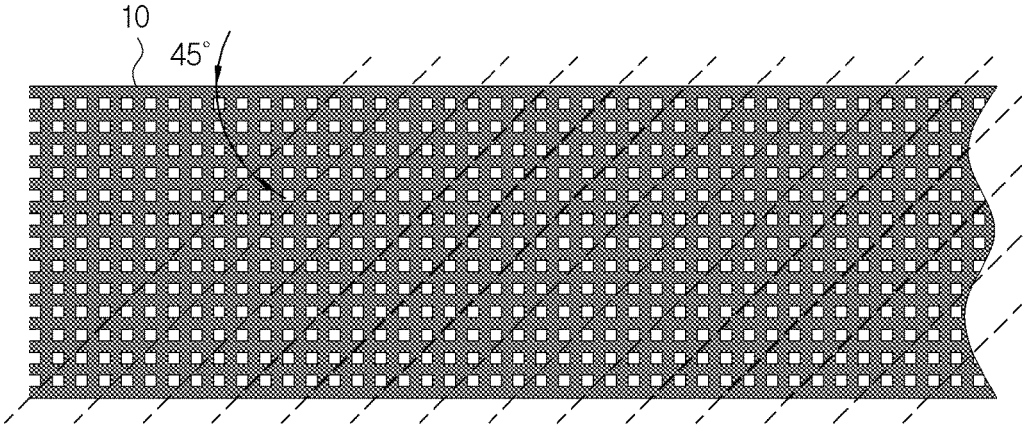
FIG. 3 is a view illustrating a process of manufacturing a core strip by cutting a core fabric in a diagonal oblique direction by a predetermined width in a method of manufacturing a candle tape for ignition according to an embodiment of the present invention.

FIG. 3 is a view illustrating a process of manufacturing a core strip by cutting a core fabric in a diagonal direction in a unit of a predetermined width in a method of manufacturing a candle tape for ignition according to an embodiment of the present invention. Referring to FIG. 1 again, as illustrated in FIG. 3, A plurality of core strips are manufactured by cutting the core fabric 10 in the diagonal direction (along the dotted lines of FIG. 3), preferably, at 45 degrees, in a unit of a predetermined width, for example, a length in the range of 1 cm to 5 cm. The cutting process may be automatically performed, for example, by using a cutting tool using a cutter.

Figure 4:
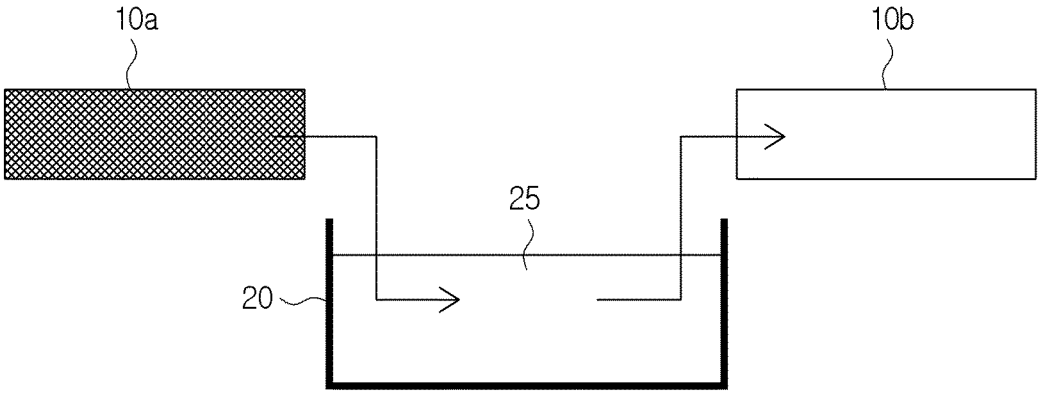
FIG. 4 is a view illustrating a process of coating paraffin on a core strip in a method of manufacturing a candle tape for ignition according to an embodiment of the present invention.

Then, as shown in FIG. 4, in step S30, paraffin is coated on the core strip prepared through the cutting process. FIG. 4 is a view illustrating a process of coating paraffin on the core strip in a method of manufacturing a candle tape for ignition according to an embodiment of the present invention. Next, as shown in FIG. 4, the core material strip 10*a* obtained by the cutting process is immersed in liquid paraffin 25 contained in a paraffin tank 20 for a short time and taken out from the liquid paraffin. In this case, the liquid paraffin 250 is uniformly impregnated into the core fiber of the core strip 10*a* and hardened in the state that the paraffin 250 is coated on the core strip 10*a*. Reference numeral 10*b* represents the core strip on which the liquid paraffin 25 is coated. Meanwhile, it is preferable to maintain the paraffin tank 20 at a predetermined temperature, for example, in the range of 50° C. to 70° C. such that the liquid paraffin 25 stably maintains the liquid state in the paraffin tank 20.

Figure 5:
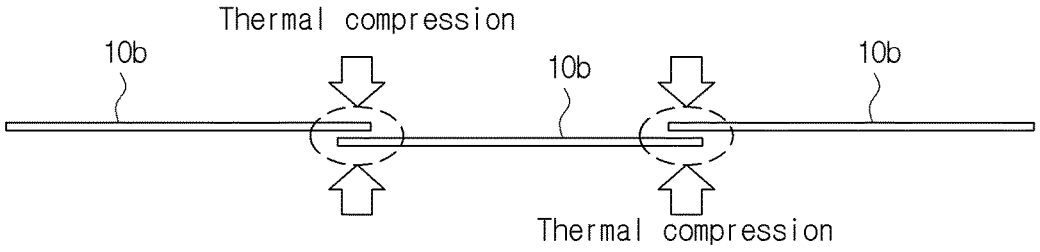
FIG. 5 is a view illustrating a process of connecting core strips immerged into paraffin to each other in a method of manufacturing a candle tape for ignition according to an embodiment of the present invention.

Referring to FIG. 1 again, in step S40, two core strips 10*b* coated with paraffin are connected to each other through thermal compression with their ends attached to each other. In this case, the paraffin is melted by heat and acts as a bond, so that the connection state is maintained as long as a large external force sufficient to forcibly cut the core strip by hand is not applied thereto. FIG. 5 is a view illustrating a process of connecting the core strips coated with the paraffin to each other in a method of manufacturing a candle tape for ignition according to an embodiment of the present invention. As illustrated in FIG. 5, it is possible to simultaneously connect two or more core belts 10*b* (three in the embodiment of FIG. 5) at a time. The compression temperature may be, for example, in the range of 50° C. to 70° C. Such a thermal compression process may also be performed automatically using a thermal compression press.

Figure 6:
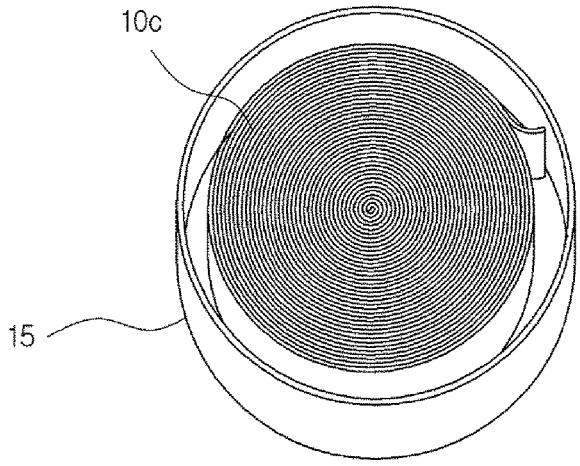
FIG. 6 is a perspective view exemplarily showing a candle tape contained in a packaging container after the candle tape is prepared in a roll tape form by a method of manufacturing a candle tape for ignition according to an embodiment of the present invention.

FIG. 6 is a perspective view exemplarily showing a candle tape contained in a packaging container after the candle tape is prepared in a roll tape form by a method of manufacturing a candle tape for ignition according to an embodiment of the present invention. Referring to FIG. 1 again, in step S50, the connected core strips are wound by a predetermined length to shape a roll tape 10*c* form shown in FIG. 6. Then, in step S60, the manufacture is completed by putting the shaped roll tape 10*c* into a packaging container 15, preferably a disk-shaped container 15.

Meanwhile, the core tape 10*c* itself is wound up to form a roll tape in the embodiment of FIG. 6, but the core tape 10*c* may be wound around a circular bobbin (reel: not shown).

Figure 7:
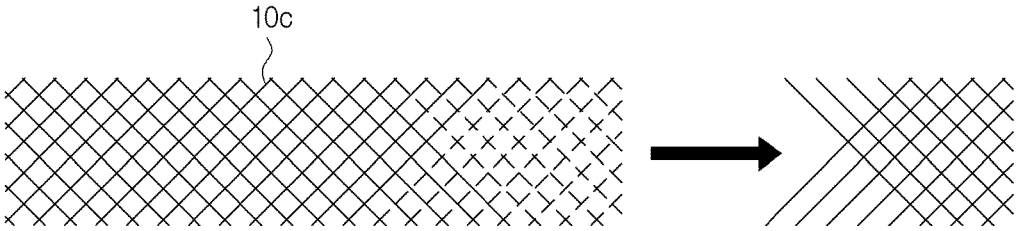
FIG. 7 is a view exemplarily showing a process of cutting a candle tape for ignition according to an embodiment of the present invention.
Figure 8:
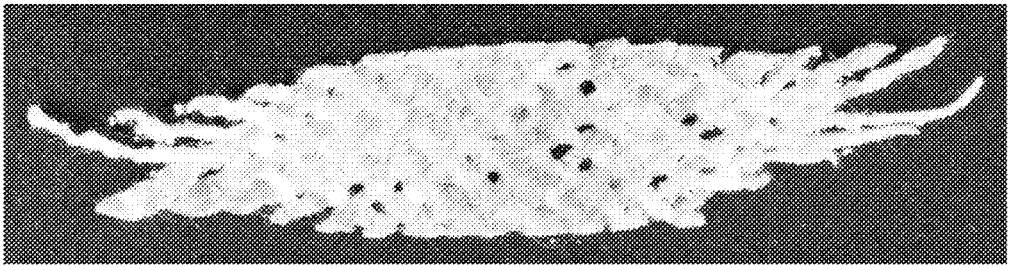
FIG. 8 is a photograph showing a part obtaining by cutting a candle tape for ignition cut according to an embodiment of the present invention.

FIG. 7 is a view exemplarily showing a process of cutting a candle tape for ignition according to an embodiment of the present invention. As shown in FIG. 7, since the candle tape 10*c* according to an embodiment of the present invention is manufactured by cutting the core fabric in an oblique direction, the woof line and longitudinal line are orthogonal to each other in a diagonal direction. Thus, in a state that the body of the candle tape 10*c* is held by one hand and a portion of the candle tape 10*c* desired to be cut off is held by the other hand (see the dot line), if the tape 10*c* is slightly pulled, the candle tape 10*c* is easily cut without applying large force. FIG. 8 is a photograph showing a part obtaining by cutting a candle tape for ignition cut according to an embodiment of the present invention.

In a situation when solid fuel is ignited for barbecuing or grilling meat outdoors, if firewood is ignited for campfire, when solid fuel is ignited for heating in other outdoor activities, or when firewood is ignited in an indoor fireplace, the candle tape according to an embodiment of the present invention may be easily cut in a desired length for use by hand without using a cutting tool, such as a knife or scissors. In this case, since the candle tape according to an embodiment of the present invention is easily bent even with small force and kept in the bent state, when a cut candle tape is ignited while being wound around a wood piece, a large fire may be caused in a short time.

As described above, although the preferable embodiments of a method of manufacturing candle tape for ignition and a candle tape thereby according to the present invention have been described for illustrative purposes with reference to accompanying drawings, those skilled in the art will appreciate that various modifications, additions and substitutions are possible, without departing from the scope and spirit of the invention as disclosed in the accompanying claims. For example, in a case that the fabric has a sufficiently large width, that is, each core strip 10*a* manufactured through the cutting process of step S20 has a sufficient length to form one roll, the connecting process may be omitted. In addition, it is possible to change the order of the cutting process of step S20 and the paraffin coating process of step S30. Differently from the embodiments described above, it is also possible to apply paraffin to the core strip in a scheme of coating liquid paraffin to the core strip or the core fabric using a brush, roller or spray.

Accordingly, the scope of the present invention should be determined by the following claims.

What is claimed is:

1. A method of manufacturing a candle tape for ignition, the method comprising:

weaving a core fiber into a core fabric;

cutting the core fabric in a diagonal direction in a unit of a predetermined width to prepare a core strip; and coating paraffin on the core strip prepared by the cutting of the core fabric.

2. The method of claim 1, wherein the coating of the paraffin comprises immersing the core strip in liquid paraffin.

3. A method of manufacturing a candle tape for ignition, the method comprising:

weaving a core fiber into a core fabric;

coating paraffin on the core fabric; and cutting the core fabric, on which the paraffin is coated, in a diagonal direction in a unit of a predetermined width.

4. The method of claim 3, wherein the coating of the paraffin comprises immersing the core fabric in liquid paraffin.

5. The method of claim 1, wherein the core fabric includes a jute fiber.

6. The method of claim 1, further comprising bonding ends of at least two core strips coated with the paraffin to each other through thermal compression in a state that the ends of the at least two core strips overlap each other.

7. The method of claim 1, further comprising shaping the core strip, on which the paraffin is coated, in a roll tape shape.

8. The method of claim 2, wherein the core fabric includes a jute fiber.

9. The method of claim 3, wherein the core fabric includes a jute fiber.

10. The method of claim 4, wherein the core fabric includes a jute fiber.

11. The method of claim 2, further comprising bonding ends of at least two core strips coated with the paraffin to each other through thermal compression in a state that the ends of the at least two core strips overlap each other.

12. The method of claim 3, further comprising bonding ends of at least two core strips coated with the paraffin to each other through thermal compression in a state that the ends of the at least two core strips overlap each other.

13. The method of claim 4, further comprising bonding ends of at least two core strips coated with the paraffin to each other through thermal compression in a state that the ends of the at least two core strips overlap each other.

14. The method of claim 2, further comprising shaping the core strip, on which the paraffin is coated, in a roll tape shape.

15. The method of claim 3, further comprising shaping the core strip, on which the paraffin is coated, in a roll tape shape.

16. The method of claim 4, further comprising shaping the core strip, on which the paraffin is coated, in a roll tape shape.

* * * * *